US011505852B2

(12) United States Patent
Luo et al.

(10) Patent No.: US 11,505,852 B2
(45) Date of Patent: Nov. 22, 2022

(54) YTTRIUM-ADDED RARE-EARTH PERMANENT MAGNETIC MATERIAL AND PREPARATION METHOD THEREOF

(71) Applicant: GRIREM ADVANCED MATERIALS CO., LTD., Beijing (CN)

(72) Inventors: Yang Luo, Beijing (CN); Xiao Lin, Beijing (CN); Guiyong Wu, Beijing (CN); Jiajun Xie, Beijing (CN); Zilong Wang, Beijing (CN); Wenlong Yan, Beijing (CN); Zhongkai Wang, Beijing (CN); Dunbo Yu, Beijing (CN)

(73) Assignee: GRIREM ADVANCED MATERIALS CO., LTD., Beijing (CN)

( * ) Notice: Subject to any disclaimer, the term of this patent is extended or adjusted under 35 U.S.C. 154(b) by 165 days.

(21) Appl. No.: 16/791,088

(22) Filed: Feb. 14, 2020

(65) Prior Publication Data

US 2020/0263280 A1 Aug. 20, 2020

(30) Foreign Application Priority Data

Feb. 19, 2019 (CN) ..... 201910123111.4

(51) Int. Cl.

| | |
|---|---|
| ***C22C 38/00*** | (2006.01) |
| ***H01F 1/059*** | (2006.01) |
| ***H01F 41/02*** | (2006.01) |
| ***B22F 9/04*** | (2006.01) |
| ***B22F 1/00*** | (2022.01) |

(52) U.S. Cl.

CPC ..... *C22C 38/005* (2013.01); *B22F 1/0007* (2013.01); *B22F 9/04* (2013.01); *C22C 38/001* (2013.01); *H01F 1/059* (2013.01); *H01F 41/0266* (2013.01); *B22F 2009/048* (2013.01); *B22F 2301/355* (2013.01); *B22F 2304/10* (2013.01)

(58) Field of Classification Search

None

See application file for complete search history.

(56) References Cited

FOREIGN PATENT DOCUMENTS

CN 108630371 A * 10/2018 ..... C22C 38/12

OTHER PUBLICATIONS

Machine translation of CN 108630371 A. (Year: 2018).*

Yamamoto, J. Jpn. Soc. Powder Powder Metallurgy, vol. 55, No. 7, p. 522-528. (Year: 2008).*

* cited by examiner

*Primary Examiner* — Xiaowei Su

(74) *Attorney, Agent, or Firm* — Dragon Sun Law Firm, PC; Jinggao Li; Nathaniel Perkins

(57) ABSTRACT

The present disclosure discloses an yttrium (Y)-added rare-earth permanent magnetic material and a preparation method thereof. A chemical formula of the material expressed in atomic percentage is (YxRE1-x)aFebalMbNc, wherein $0.05 \leq x \leq 0.4$, $7 \leq a \leq 13$, $0 \leq b \leq 3$, $5 \leq c \leq 20$, and the balance is Fe, namely, bal=100-a-b-c; RE represents a rare-earth element Sm, or a combination of the rare-earth element Sm and any one or more elements of Zr, Nd and Pr; M represents Co and/or Nb; and N represents nitrogen. In the preparation method, the rare-earth element Y is utilized to replace the element Sm of a samarium-iron-nitrogen material. By regulating a ratio of the element Sm to the element Y, viscosity of an alloy liquid can be reduced, and an amorphous forming ability of the material is enhanced.

10 Claims, 2 Drawing Sheets

YTTRIUM-ADDED RARE-EARTH PERMANENT MAGNETIC MATERIAL AND PREPARATION METHOD THEREOF

CROSS-REFERENCE TO RELATED PATENT APPLICATION

This application claims priority to and the benefit of CN201910123111.4, filed Feb. 19, 2019, entitled "YTTRIUM-ADDED RARE-EARTH PERMANENT MAGNETIC MATERIAL AND PREPARATION METHOD THEREOF," by Yang LUO et al. The entire disclosure of the above-identified application is incorporated herein by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

TECHNICAL FIELD

The present disclosure relates to the field of rare-earth permanent magnetic materials, and more particularly to an yttrium-added rare-earth permanent magnetic material and a preparation method thereof.

BACKGROUND

The neodymium-iron-boron (NdFeB) rare-earth permanent magnetic material has been widely used in many fields such as electronics, medical equipment, automotive industry, energy and transportation since its discovery because of its superior comprehensive magnetic properties. In addition, with annual increases in output and consumption of NdFeB, the consumption rates of metal neodymium as a raw material and metal dysprosium as a common additive are increasing, resulting in the increase of material cost year by year. On the other hand, with the further promotion and application of permanent magnet motors in the field of electric vehicles and intelligent home appliances, the demand for the permanent magnet motors in the motor market is continuously increasing. Thus, seeking a magnetic material to replace NdFeB has been put on the agenda.

At present, a $TbCu_7$-type metastable phase is stabilized mainly by adding a third element such as Ti, Nb, Al, or Si to replace a Fe site so as to decrease a roller speed. However, the addition of a certain amount of the above element will reduce a saturation magnetization of the alloy. The metastable phase can be stabilized by replacing a rare-earth site with the rare-earth element Y having a smaller atomic radius, and the magnetic polarization is basically unchanged.

Therefore, a heretofore unaddressed need exists in the art to address the aforementioned deficiencies and inadequacies.

SUMMARY

I. Objects of the Present Disclosure

Objects of the present disclosure are to provide an yttrium (Y)-added rare-earth permanent magnetic material and a preparation method thereof. Meanwhile, a $TbCu_7$ metastable phase structure can be stabilized by adding Y, and excellent magnetic properties can be obtained without reducing a saturation magnetization.

II. Technical Solutions

To achieve the above objects, the present disclosure adopts the technical solutions described below.

A first aspect of the present disclosure provides an yttrium (Y)-added rare-earth permanent magnetic material, wherein a chemical formula of the material expressed in atomic percentage is $(Y_xRE_{1-x})_aFe_{bal}M_bN_c$;

where $0.05 \le x \le 0.4$, $7 \le a \le 13$, $0 \le b \le 3$, $5 \le c \le 20$, and the balance is Fe, namely, bal=100-a-b-c;

RE represents a rare-earth element Sm, or a combination of the rare-earth element Sm and any one or more elements of Zr, Nd and Pr; M represents Co and/or Nb; and N represents nitrogen.

Further, the material contains a $TbCu_7$ phase, a $Th_2Zn_{17}$ phase, and a-Fe phase that is a soft magnetic phase;

the content of the $TbCu_7$ phase in the material is preferably more than 70 vol % of the total volume content of the three phases, more preferably, more than 90 vol %, and further preferably, more than 95 vol %;

and/or, the content of the $Th_2Zn_{17}$ phase is 0-30 vol % of the total volume content of the three phases, excluding 0, and preferably, is 1-10 vol %;

and/or, the content of the a-Fe phase as soft magnetic phase in the rare-earth permanent magnet material is less than 1 vol % of the total volume content of the three phases.

Further, the atomic percentage of M is within 3%; and preferably, the atomic percentage of M is within 1.5%.

Further, the atomic percentage of the element Sm in RE is more than 95%.

Further, the proportion of the element Y entering the $TbCu_7$ phase and/or the $Th_2Zn_{17}$ phase is 100%.

Further, the rare-earth permanent magnetic material has an average thickness of 20-40 μm, and is composed of nanometer crystals with an average crystal grain size of 20-100 nm, and an amorphous material; and a preferable standard deviation of crystal grain sizes is 2-5.

Further, an XRD peak of the rare-earth permanent magnetic material is wholly shifted rightwards by 1%-5%.

Further, the material is obtained by introducing the element Y into a samarium-iron-nitrogen magnet through a preparation process in which the nanometer crystals are bonded onto a permanent magnetic material.

Another aspect of the present disclosure provides a preparation method of the above yttrium-added rare-earth permanent magnetic material, the method comprising the following steps:

(1) smelting an alloy containing Sm, Y, and Fe as main compositions and added with element Co and/or Nb into an ingot;

(2) casting the ingot after being melted at a high temperature to a rotating roller to be subjected to rotating melt-spinning cooling to obtain a melt-spun ribbon;

(3) quenching the melt-spun ribbon obtained in step (2) after being crystallized, and pulverizing the quenched melt-spun ribbon into an alloy powder; and (4) nitriding the alloy powder obtained in step (3) in a tubular furnace to obtain the yttrium-added rare-earth permanent magnetic material.

Further, the smelting in step (1) is vacuum induction smelting.

Preferably, a temperature of the high-temperature melting in step (2) is 200-400° C. above a melting point of a raw material for preparing the melt-spun ribbon.

Preferably, a heat preservation time of the high-temperature melting is 60-180 s.

Preferably, the casting in step (2) is implemented through a high-vacuum single-roller rotating melt-spinning method; further preferably, a speed of the rotating melt-spinning roller is 20-40 m/s; and further preferably, a cooling rate of the rotating melt-spinning cooling is $1*10^5$-$5*10^{6}$° C./s.

Further, the crystallizing in step (3) has a temperature of 650-800° C., and a time of 40-70 min.

Preferably, the crystallizing is performed in a flowing Ar gas atmosphere.

Preferably, the quenching is water-cooling quenching.

Preferably, the quenching process is performed in the flowing Ar gas atmosphere;

Preferably, a quenching time is 50-70 min.

Preferably, an average grain size of the alloy powder is 70-110 μm.

III. Beneficial Effects

The above technical solutions of the present disclosure have the following beneficial technical effects.

1. According to the yttrium-added rare-earth permanent magnetic material and the preparation method thereof provided by the present disclosure, the average crystal grain size of the prepared magnetic powder is 20-100 nm; the standard deviation is 2-5; and the grain size distribution is more concentrated with respect to a binary SmFe. Thus, deterioration of the magnetic properties caused by non-uniform crystal grain size distribution is effectively avoided, thereby facilitating the improvement of the magnetic properties.

2. By replacing the element Sm of the samarium-iron-nitrogen material with the rare-earth element Y to, and regulating a ratio of the element Sm to the element Y, viscosity of an alloy liquid can be reduced, and an amorphous forming ability of the material is enhanced, so that the production cost is reduced.

3. In the present disclosure, by utilizing a feature that the element Y does not contain 4f electrons and thus contributes less to an anisotropic field, the magnetic properties of the SmFeN material are effectively regulated by regulating a doping amount of the element Y, so that disadvantages of higher coercivity and lower residual magnetism are overcome. Thus, the magnetic properties of the prepared magnetic powder can well meet a property requirement on a magnet in manufacturing of an electric motor, filling a gap in application of the properties of the magnet by the electric motor.

BRIEF DESCRIPTION OF THE DRAWINGS

The accompanying drawings illustrate one or more embodiments of the present disclosure and, together with the written description, serve to explain the principles of the invention. Wherever possible, the same reference numbers are used throughout the drawings to refer to the same or like elements of an embodiment.

DETAILED DESCRIPTION

Figure 1:
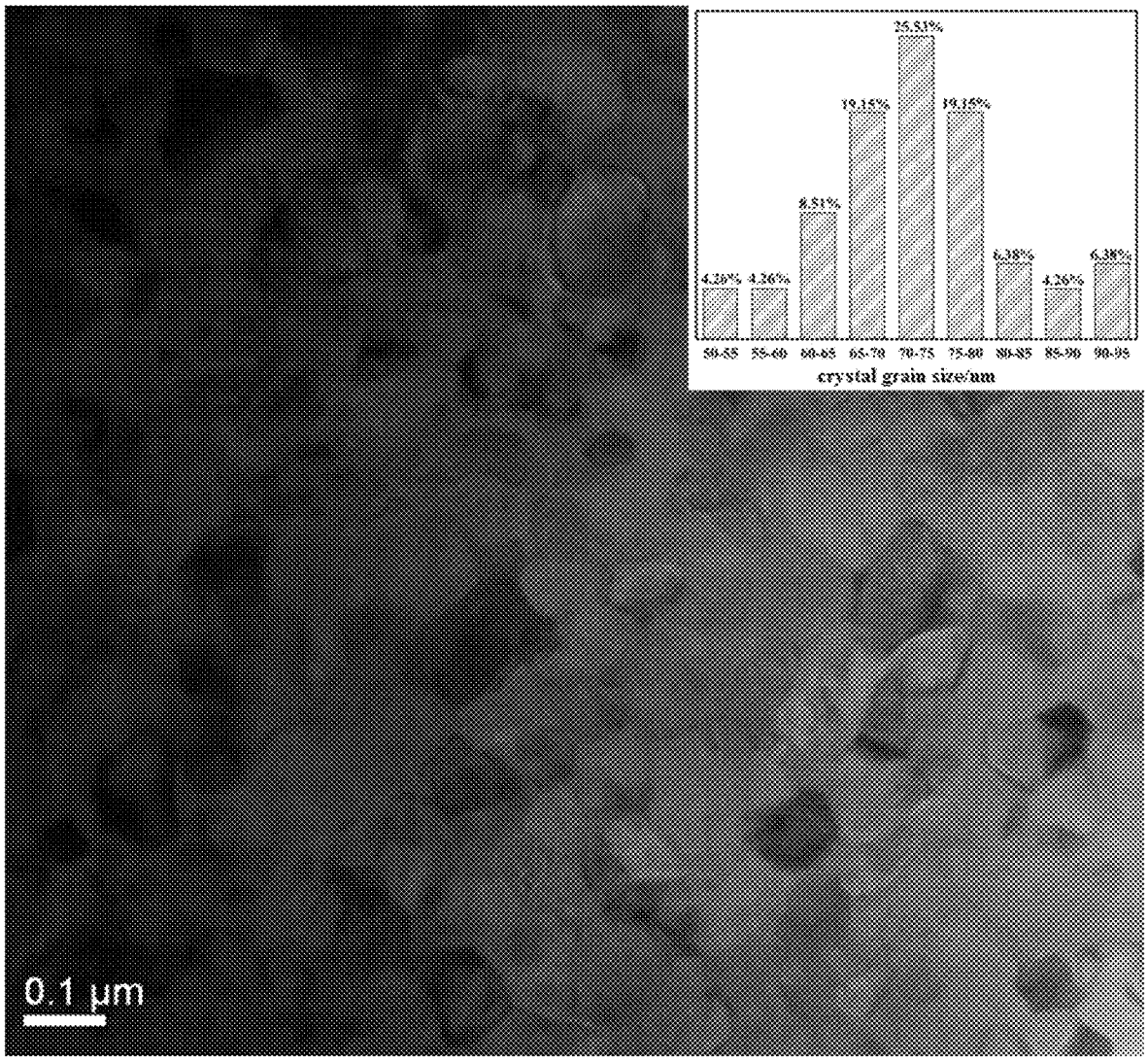
FIG. 1 shows a TEM image and a crystal grain size statistical graph of a permanent magnetic material with an alloy composition of $(Sm_{0.7}Y_{0.3})_{8.5}Fe_{79}N_{12.5}$ (at %)
Figure 2:
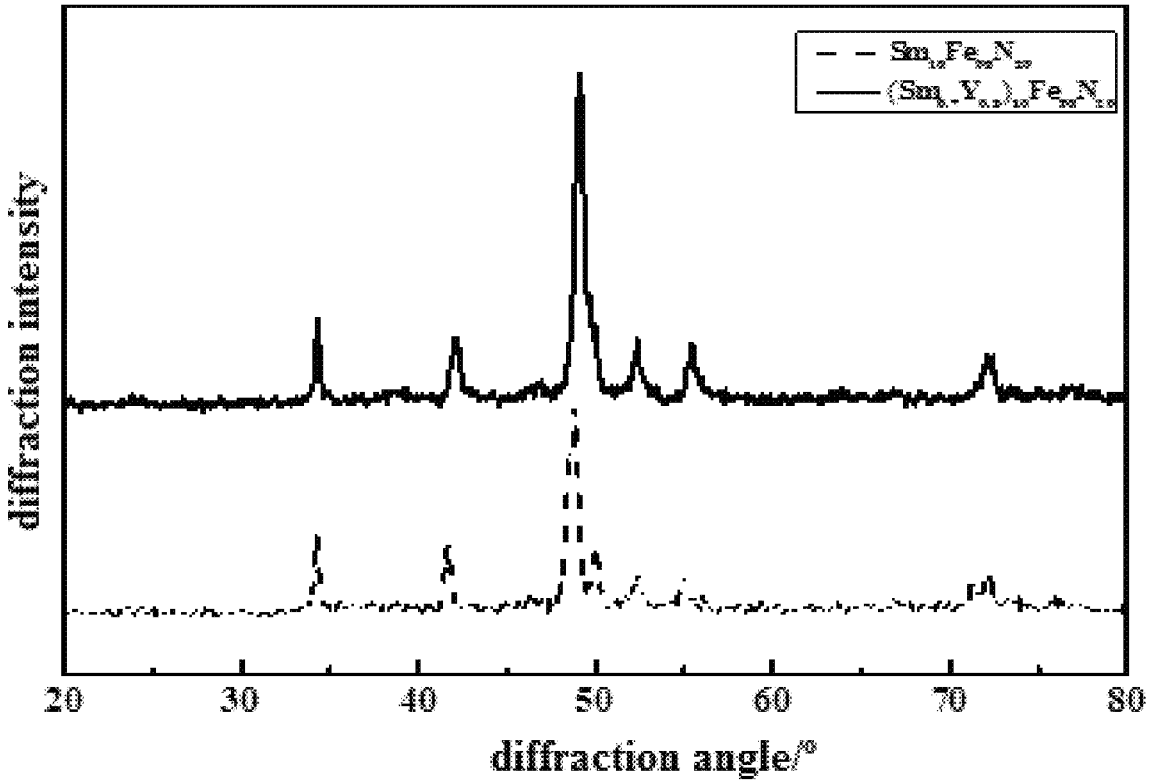
FIG. 2 shows an XRD comparison diagram of $(Sm_{0.7}Y_{0.3})_{8.5}Fe_{79}N_{12.5}$ and $Sm_{8.5}Fe_{79}N_{12.5}$ when a roller speed is 30 m/s.

The present disclosure will now be described more fully hereinafter with reference to the accompanying drawings, in which exemplary embodiments of the present disclosure are shown. The present disclosure may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

Embodiments of the invention are illustrated in detail hereinafter with reference to accompanying drawings. It should be understood that specific embodiments described herein are merely intended to explain the invention, but not intended to limit the invention.

In order to explain the objects, technical solutions and advantages of the present disclosure more apparently, the present disclosure is further described in detail below in connection with the specific embodiments with reference to accompanying drawings. It should be understood that these descriptions are merely exemplary and are not intended to limit the scope of the present disclosure. In addition, in the following description, descriptions of well-known structures and techniques are omitted to avoid unnecessary obscuring of the concepts of the present disclosure.

A first aspect of the present disclosure provides an yttrium-added rare-earth permanent magnetic material. A chemical formula of the material expressed in atomic percentage is $(Y_xRE_{1-x})_aFe_{bal}M_bN_c$, wherein $0.05 \le x \le 0.4$, $7 \le a \le 13.0 \le b \le 3$, $5 \le c \le 20$, and the balance is Fe, namely, bal=100-a-b-c; RE represents the rare-earth element Sm, or a combination of the rare-earth element Sm and any one or more elements of Zr, Nd and Pr; M represents Co and/or Nb; and N represents nitrogen.

The rare-earth permanent magnetic material provided by the present disclosure effectively improves a structural stability of the $TbCu_7$-type metastable phase SmFe without reducing a saturation magnetization. The volume percentage of the $TbCu_7$ phase in the material obtained at a roller speed of 20-40 m/s is more than 70 vol % of the total volume content of three phases (including a $TbCu_7$ phase, a $Th_2Zn_{17}$ phase, and an a-Fe phase as soft magnetic phase), preferably more than 95 vol %, so that the production cost is significantly reduced. A content of rare-earth element Sm in RE has a great influence on a phase structure of a melt-spun SmFe alloy ribbon. When the Sm content is lower, it is easy to form a soft magnetic phase; when the Sm content is higher, it is easy to form a Sm-enriched phase, both of which are not conducive to the preparation of a melt-spun alloy whose main phase $TbCu_7$ is more than 95 vol % of the total volume content. In addition, Zr, Nd, and Pr can replace the element Sm. Therefore, it is preferred in the present disclosure that the atomic percentage of RE is more than 70% of the total atomic percentage of the material, and the atomic percentage of the Sm in RE is more than 95%.

Preferably, the material contains the $TbCu_7$ phase, the $Th_2Zn_{17}$ phase, and the a-Fe phase as soft magnetic phase.

Preferably, the content of the $TbCu_7$ phase in the material is preferably more than 70 vol % of the total volume content of the three phases, more preferably, more than 90 vol %, and further preferably, more than 95 vol %.

Preferably, the content of the $Th_2Zn_{17}$ phase is 0-30 vol % of the total volume content of the three phases, excluding 0, and preferably, is 1-10 vol %.

Preferably, the content of the a-Fe phase as soft magnetic phase in the rare-earth permanent magnet material is less than 1 vol % of the total volume content of the three phases.

Preferably, the atomic percentage of M is within 3%; and more preferably, the atomic percentage of M is within 1.5%.

Preferably, the atomic percentage of the element Sm in RE is more than 95% of the total content of RE.

Preferably, the proportion of the element Y entering the $TbCu_7$ phase and/or the $Th_2Zn_{17}$ phase is 100%. As this system only contains the three phases including the $TbCu_7$ phase, the $Th_2Zn_{17}$ phase, and the a-Fe phase, and does not contain other phases containing the element Y, the element Y can only 100% enter the $TbCu_7$ phase and/or the $Th_2Zn_{17}$ phase.

Preferably, the rare-earth permanent magnetic material has an average thickness of 20-40 μm, and is composed of nanometer crystals with an average crystal grain size of 20-100 nm, and an amorphous material; and a preferable standard deviation of crystal grain sizes is 2-5. This standard deviation is configured to measure a deviation extent of a data value from the arithmetic average.

The thickness of the melt-spun alloy is related to the preparation method thereof. The $TbCu_7$-type structure needs a larger cooling rate, but an excessively large cooling rate is not conducive to the formation of the ribbon. Therefore, the thickness of the prepared samarium-iron alloy should be appropriate. The crystal grain size of the magnetic powder directly affects the magnetic properties. The magnetic powder with fine and uniform crystal grains are higher in coercivity and thermal stability. Generally, the magnetic powder is endowed with the better magnetic properties when the crystal grain size of the magnetic powder is kept at 20-100 nm. In order to enable the magnetic powder to have a higher coercivity and an improved thermal stability, the preferable crystal grain sizes of the magnetic powder are 10-60 nm, and the preferable standard deviation of the crystal grain sizes is preferably 2-5.

Preferably, an XRD (X-ray diffraction) peak of the permanent magnetic powder of the rare-earth permanent magnetic material is wholly shifted rightwards by 1%-5%.

Preferably, the material is obtained by introducing the element Y into the samarium-iron-nitrogen magnet through a preparation process in which the nanometer crystals are bonded onto a permanent magnetic material.

Preferably, the average crystal grain size of the prepared magnetic powder is 20-100 nm; the standard deviation is 2-5; and the grain size distribution is more concentrated with respect to a binary SmFe. Thus, deterioration of the magnetic properties caused by non-uniform crystal grain size distribution is effectively avoided, thereby facilitating the improvement of the magnetic properties.

In the present disclosure, through the addition of the rare-earth element Y, the material is optimized in composition, and is reduced in viscosity, so that a problem that the binary SmFe alloy has large viscosity and poor amorphous forming ability is solved. Meanwhile, the element Y with a smaller atomic radius replaces Sm in atom site, so that the average atomic radius of the rare-earth element is reduced, thereby stabilizing the $TbCu_7$ structure. Thus, the alloy in which the content of the $TbCu_7$ phase is greater than 70 vol % can also be obtained at a low roller speed.

In the present disclosure, by replacing the rare-earth element Sm with the rare-earth element Y, the phenomenon that in the prior art, saturation magnetization is reduced as a transition group metal is added to replace Fe in atom site is avoided. Meanwhile, with an antiferromagnetic coupling between the element Y and the element Fe, the saturation magnetization is further increased, so that the residual magnetism is further increased, thereby greatly improving the magnetic properties.

Preferably, the content of Y is 0-20 at %, excluding 0, which can effectively improve the residual magnetism of the magnet.

In the present disclosure, through the addition of the element Y, the squareness of a demagnetizing curve is improved, so that the properties of the magnet can well meet a requirement on a raw material in manufacturing of an electric motor. Nitrided binary SmFe has problems of a relatively high coercivity and low residual magnetism, namely, poor squareness, which adversely affects a final magnetic energy product. Therefore, the problem of the poor squareness caused by the relatively high coercivity and low residual magnetism of the nitrided binary SmFe can be solved by adding the rare-earth element Y as it does not contain 4f electrons and contributes less to the anisotropic field of the alloy, so that the overall magnetic properties of the magnet can well meet the property requirement on the magnet in manufacturing of the electric motor.

Another aspect of the present disclosure provides a preparation method of the above yttrium-added rare-earth permanent magnetic material. The preparation method includes the following steps.

(1) An alloy containing Sm, Y, and Fe as main compositions and added with element Co and/or Nb is smelted into an ingot, and the ingot after being melted at a high temperature is cast to a rotating roller to be subjected to rotating melt-spinning cooling to obtain a melt-spun ribbon.

(2) The ingot after being melted at a high temperature is cast to a rotating roller to be subjected to rotating melt-spinning cooling to obtain a melt-spun ribbon.

(3) The melt-spun ribbon obtained in step (2) after being crystallized is quenched, and the quenched melt-spun ribbon is pulverized into an alloy powder.

(4) The alloy powder obtained in step (3) is nitrided in a tubular furnace to obtain the yttrium-added rare-earth permanent magnetic material.

A rare-earth element required by the raw material in preparation is a single rare-earth metal.

Preferably, the melting in step (1) is vacuum induction melting.

Preferably, a temperature of the high-temperature melting is 200-400° C., for example, 205° C., 225° C., 240° C., 260° C., 280° C., 300° C., 330° C., 350° C., 370° C., 390° C., etc., above a melting point of the raw material for preparing the melt-spun ribbon.

Preferably, a heat preservation time of the high-temperature melting is 60-180 s, for example, 70 s, 90 s, 110 s, 120 s, 140 s, 150 s, 170 s, etc.

Preferably, the casting is implemented through a high-vacuum single-roller rotating melt-spinning method.

Preferably, a speed of the rotating melt-spinning roller is 20-40 m/s, for example, 22 m/s, 25 m/s, 27 m/s, 29 m/s, 30 m/s, 32 m/s, 35 m/s, 38 m/s, etc.

Preferably, a cooling rate of the rotating melt-spinning cooling is $1*10^5$-$5*10^{6}$° C./s, for example, $2*10^{5}$° C./s, $4*10^{5}$° C./s, $6*10^{5}$° C./s, $8*10^{5}$° C./s, etc. The greater the subcooling degree is, the larger the growth rate of the alloy during solidification is.

With different speeds of the rotating melt-spinning roller, the cooling rates of the alloy liquid are different, and accordingly, the microstructure, thermodynamics and dynamics of the system will change differently. If the roller speed is too low, (2:17)-type SmFe phase and $TbCu_7$-type $SmFe_9$ phase will appear simultaneously. The lower the roller speed is, the greater the proportion of the (2:17)-type SmFe phase is; and meanwhile, an a-Fe phase is precipitated out. If the roller speed is too high, with the increase of the rotation speed of the roller, the obtained melt-spun ribbon gradually evolves to an amorphous ribbon. The spatial arrangement of atoms of the amorphous ribbon changes significantly, resulting in a trend of decrease of both $H_c$ and $B_s$. In this experiment, by optimizing the roller speed, the alloy melt is rapidly cooled (with the cooling rate of $1*10^5$-$5*10^{6}$° C./s) or heterogeneous nucleation in the cooling process is suppressed, so that the alloy is solidified with a high growth rate (equal to or greater than 1-100 cm/s) under a greater subcooling degree to prepare amorphous, quasi-crystal and nano alloy materials. After rapid solidification, an amorphous or nano-crystal metastable melt-spun ribbon can be obtained.

In an embodiment, the high-temperature melting refers to melting of the raw material at a temperature 200-400° C. above the melting point of the material of the melt-spun ribbon; the speed of the rotating melt-spinning roller is 20-40 m/s; and in the rotating melt-spinning cooling step, the cooling rate is $1*10^5$-$5*10^{6}$° C./s.

Preferably, in step (3), the crystallizing temperature is 650-800° C., for example, 650° C., 710° C., 730° C., 750° C., 770° C., 790° C., 800° C., etc.; and the crystallizing time is 40-70 min, for example, 45 min, 50 min, 55 min, 60 min, 65 min, etc.

The melt-spun ribbon is a disordered material with a large number of amorphous microstructures and defects such as dislocations and vacancies. Thus, in order to improve the magnetic properties of the material, it is required to effectively crystallize a melt-spun sample. In the present disclosure, for obtaining a nanocrystal material with a uniform size, it is necessary for the alloy to be subjected to a large amount of nucleation in a short time from the disordered amorphous state. Thermodynamic experiments show that for a nucleation experiment, a crystallizing time of generally 40-70 min and a crystallizing temperature of 650-800° C. are beneficial to a large amount of nucleation.

Preferably, quenching is water-cooling quenching. The crystallized alloy is immersed in cold water.

Preferably, the quenching process is performed in the flowing Ar gas atmosphere.

Preferably, a quenching time is 40-70 min, for example, 40 min, 45 min, 50 min, 55 min, 60 min, 65 min, 70 min, etc.

As a key procedure in the crystallizing, quenching cooling directly affects the microstructures and properties of the sample after crystallizing. When cooling, the cooling rate should be greater than a critical cooling rate to ensure that the alloy has a stable microstructure. The quenching time should be long enough to enable the alloy sample to be water-cooled sufficiently, so as to avoid re-growth of crystal grains and possible oxidation on the surface of the alloy. Quenching in the flowing Ar gas atmosphere can not only avoid the possible oxidation of the sample at a high temperature, but also take away part of the heat through the Ar gas flow to improve the cooling efficiency.

Preferably, an average grain size of the alloy powder is 70-110 μm, for example, 70 μm, 75 μm, 80 μm, 90 μm, 95 μm, 100 μm, 105 μm, 110 μm, etc. The melt-spun ribbon can be crushed into alloy powder having the average grain size of 70-110 μm by coarse crushing and grinding.

Before the nitriding process, the grain size of the alloy powder to be nitrided is very important as it directly affects the absorption of nitrogen by the alloy powder in the nitriding process. If the grain size of the alloy powder is too large, it is difficult for nitrogen atoms to enter the crystal structure. If the grain size of the alloy powder is too small, an oxide film layer will be formed as the alloy powder is likely to be oxidized due to the large specific surface area. As a result, diffusion is not smooth, which greatly reduces the nitriding effect. In addition, finer powder particles cannot meet market demands for grain sizes of the magnetic powder.

Preferably, the temperature of the nitriding process in step (4) is 400-500° C., for example, 400° C., 420° C., 440° C., 450° C., 480° C., 490° C., 500° C., etc. The time of the nitriding is 15-25 h, for example, 15 h, 16 h, 18 h, 20 h, 22 h, 24 h, 25 h, etc.

The nitriding process qualitatively improves the properties of the $TbCu_7$-type $SmFe_9$ phase magnet. The nitriding temperature and the nitriding time are two important parameters that affect the nitriding effect. Increasing the nitriding temperature can accelerate the diffusion of nitrogen atoms in the crystal, thereby improving the nitriding effect. However, if the nitriding temperature is too high, the main phase will decompose, resulting in degradation of the magnetic properties. If the nitriding temperature is too low, a diffusion force is insufficient. Thus, there will be a region in the alloy that is not nitrided, adversely affecting the magnetic properties. In the nitriding process, with the increase of the nitriding time, the nitrogen concentration tends to be saturated. Therefore, a proper nitriding time should be selected to improve the nitriding efficiency.

Preferably, the method specifically includes the following steps.

(1) Ingredients are prepared. The metal element ingredients are weighed according to a chemical formula of $(Y_xRE_{1-x})_aFe_{bal}M_bN_c$ in atomic percentage, wherein $0.05 \le x \le 0.4$, $7 \le a \le 13$, $0 \le b \le 3$, and the balance is Fe, namely, bal=100-a-b-c; RE represents the rare-earth element Sm, or a combination of the rare-earth element Sm and any one or more elements of Zr, Nd and Pr; and M represents Co and/or Nb.

(2) A melt-spun ribbon is produced. The prepared raw material is subjected to vacuum smelting to be an ingot; a master alloy obtained after smelting is melted at a high temperature, and then the melted alloy is cast to a rotating roller through a high-vacuum single-roller rotating melt-spinning method; and rotating melt-spinning cooling is performed to obtain the melt-spun ribbon.

The raw material for preparing the melt-spun ribbon is melted at a temperature 200-400° C. above the melting point of the raw material. The speed of the rotating melt-spinning roller is 20-40 m/s. In the rotating melt-spinning cooling step, the cooling rate is $10^5$-$10^{6}$° C./s. The alloy is solidified at a high growth rate (equal to or greater than 1-100 cm/s) under a greater subcooling degree.

With different speeds of the rotating melt-spinning roller, the cooling rates of the alloy liquid are different, and accordingly, the microstructure, thermodynamics and dynamics of the system will change differently. If the roller speed is too low, (2:17)-type SmFe phase and $TbCu_7$-type $SmFe_9$ phase will appear simultaneously. The lower the roller speed is, the greater the proportion of the (2:17)-type SmFe phase is; and meanwhile, an α-Fe phase is precipitated out. If the roller speed is too high, with the increase of the rotation speed of the roller, the obtained melt-spun ribbon gradually evolves to an amorphous ribbon. The spatial arrangement of atoms of the amorphous ribbon changes significantly, resulting in a trend of decrease of both $H_c$ and $B_s$. In this experiment, by optimizing the roller speed, the alloy melt is rapidly cooled (with the cooling rate of $10^5$-$10^{6}$° C./s) or heterogeneous nucleation in the cooling process is suppressed, so that the alloy is solidified with the high growth rate (equal to or greater than 1-100 cm/s) under a greater subcooling degree to prepare amorphous, quasi-crystal and nano alloy materials. After rapid solidification, the amorphous or nano-crystal metastable melt-spun ribbon can be obtained.

(3) Crystallizing is executed. The crystallizing has a temperature of 650-800° C. and a time of 40-70 min, and is performed in a flowing Ar gas atmosphere.

Crystallizing is one of the key steps that affect the magnetic properties of the melt-spun alloy. The melt-spun SmFe alloy contains $TbCu_7$-type $SmFe_9$ phase, a small number of α-Fe soft magnetic phases, and amorphous metal. In addition, there are a large number of amorphous microstructures and defects such as dislocations and vacancies in the microstructures. Thus, in order to improve the magnetic properties of the material, it is required to effectively crystallize a melt-spun sample. Through crystallizing, on one hand, the amorphous microstructures are changed into crystal microstructures; and on the other hand, the uniformity of the microstructures is improved. If the crystallizing temperature is too high, a large number of $TbCu_7$ structures will be transformed to $Th_2Zn_{17}$ structures; and meanwhile, the α-Fe phase will be generated. As a result, the magnetic properties are severely degraded. Therefore, in the present disclosure, on the basis of adjustment of the magnetic properties by doping the element Y, the crystallizing process is optimized, and the contents of both the $Th_2Zn_{17}$ structure phase and the α-Fe soft magnetic phase in the alloy are adjusted, so that the content of the α-Fe soft magnetic phase is less than 1 vol %, the $TbCu_7$ structure phase serves as the main phase and has the content of more than 70 vol %, and the content of the $Th_2Zn_{17}$ structure phase is less than 30 vol %. Thus, the preferable heat treatment temperature is 650-800° C.

(4) Water-cooling quenching is executed. The quenching process refers to immersing the crystallized alloy in cold water, has the duration of 40-70 min, and is performed in the flowing Ar gas atmosphere.

As a key step in the crystallizing procedure, cooling directly affects the microstructures and properties of the sample after the crystallizing. When cooling, the cooling rate should be greater than a critical cooling rate to ensure that the alloy has a stable microstructure. The quenching time should be long enough to enable the alloy sample to be water-cooled sufficiently, so as to avoid re-growth of crystal grains and possible oxidation on the surface of the alloy. Quenching in the flowing Ar gas atmosphere can not only avoid the possible oxidation of the sample at a high temperature, but also take away part of the heat through the Ar gas flow to improve the cooling efficiency.

The melt-spun ribbon can be crushed into alloy powder having the average grain size of 70-110 μm by coarse crushing and grinding.

(5) Nitriding is executed. The temperature in the nitriding process is 400-500° C., and the nitriding time is 15-25 h.

The nitriding process qualitatively improves the properties of the $TbCu_7$-type $SmFe_9$ phase magnet. The nitriding temperature and the nitriding time are two important parameters that affect the nitriding effect. Increasing the nitriding temperature can accelerate the diffusion of nitrogen atoms in the crystal, thereby improving the nitriding effect. However, if the nitriding temperature is too high, the main phase will decompose, resulting in degradation of the magnetic properties. If the nitriding temperature is too low, a diffusion force is insufficient. Thus, there will be a region in the alloy that is not nitrided, adversely affecting the magnetic properties. In the nitriding process, with the increase of the nitriding time, the nitrogen concentration tends to be saturated. Therefore, a proper nitriding time should be selected to improve the nitriding efficiency.

The present disclosure provides a rare-earth-Y-added $TbCu_7$-type SmFeN nanocrystal bonded magnet. An alloy after being melted through a high-vacuum single-roller rotating melt-spinning method is sprayed onto a high-speed rotating roller. The alloy melt is rapidly cooled (with the cooling rate of $10^5$-$10^{6}$° C./s) or heterogeneous nucleation in the cooling process is suppressed, so that the alloy is solidified with a high growth rate (equal to or greater than 1-100 cm/s) under a greater subcooling degree, thereby providing a condition to prepare a metastable phase. Thus, the melt-spun ribbon with fine grains and even an amorphous structure is obtained. Then, the ribbon is crystallized and crushed. Afterwards, nitriding is performed to obtain a nitrided powder. Due to the stability of the element Y to the metastable phase $TbCu_7$ structure, a single $TbCu_7$-type main phase structure can be obtained at a lower roller speed. The average crystal grain size of the prepared magnetic powder is 20-100 nm; the standard deviation of the crystal grain sizes is 2-5; and the grain size distribution is more concentrated with respect to a binary SmFe. Thus, deterioration of the magnetic properties caused by non-uniform crystal grain size distribution is effectively avoided, thereby facilitating the improvement of the magnetic properties.

In the present disclosure, by replacing the element Sm of the samarium-iron-nitrogen material with the rare-earth element Y, and regulating a ratio of the element Sm to the element Y, viscosity of the alloy liquid can be reduced, and an amorphous forming ability of the material is enhanced. On the other hand, through the addition of Y, an average radius of the rare-earth elements is reduced, so that the $TbCu_7$ structure is stabilized. Thus, the alloy in which the content of the $TbCu_7$ phase is more than 70 vol % can be obtained at a low roller speed, thereby greatly reducing the production cost.

In the present disclosure, by utilizing a feature that the element Y does not contain 4f electrons and thus contributes less to an anisotropic field, the magnetic properties of the SmFeN material are effectively regulated by regulating a doping amount of the element Y, so that disadvantages of higher coercivity and lower residual magnetism are overcome. Thus, the magnetic properties of the prepared magnetic powder can well meet a property requirement on a magnet in manufacturing of an electric motor, filling a gap in application of the properties of the magnet by the electric motor.

In order to further illustrate the present disclosure, a preparation method of an yttrium-added rare-earth permanent magnetic material provided by the present disclosure is described in detail below with reference to the embodiments. However, it should be understood that these embodiments are implemented on the premise of the technical solutions of the present disclosure. The detailed implementations and the specific operation process are provided only to further illustrate the features and advantages of the present disclosure, but not to limit the claims of the present disclosure, and the protection scope of the present disclosure is not limited to the following embodiments.

Embodiment 1

A permanent magnetic material prepared by this embodiment has the following permanent magnet with the alloy composition of $(Sm_{0.95}Y_{0.05})_{8.5}Fe_{79}N_{12.5}$ (at %). The specific steps are as follows.

(1) A master alloy of the above alloy composition is prepared, wherein the elements Sm, Y, and Fe in the raw material are added in the form of pure metals; and then the following steps are carried out to prepare a samarium-iron-nitrogen rare-earth permanent magnetic material.

(2) The prepared raw material is placed into a vacuum arc furnace to be melted uniformly. The power current is closed, and the alloy liquid is cooled to obtain a master alloy ingot. The prepared ingot is placed into high-vacuum single-roller rotating melt-spinning equipment, and is melted at a high temperature. Then, the melt is cast to a rotating roller for melt spinning, and is cooled at a cooling rate of $10^{6}$° C./s. The rapid cooling and melt spinning process is performed in a protective atmosphere; and the alloy liquid is sprayed onto the roller rotating at a speed of 35 m/s to obtain a melt-spun ribbon.

(3) The above melt-spun ribbon is crystallized, wherein the crystallizing temperature is 750° C., and the crystallizing time is 60 min.

(4) Water-cooling quenching is performed on the crystallized melt-spun ribbon in a flowing Ar gas atmosphere for 60 min; and the melt-spun ribbon is crushed into alloy powder having the average grain size of 110 μm by coarse crushing and grinding.

(5) The above crushed alloy powder is nitrided, wherein the nitriding temperature is 450° C., and the nitriding time is 20 h. After the nitriding process is completed, the yttrium-containing samarium-iron-nitrogen bonded magnetic powder is obtained.

Properties and other parameters of tested magnetic powder are as shown in Table 1.

TABLE 1

Magnetic properties and other parameters of yttrium-containing samarium-iron-nitrogen bonded permanent magnetic powder in Embodiment 1

| Nominal composition (at %) | $B_r$ | $H_{cj}$ | $(BH)_{max}$ | Average size of crystal phases | Deviation of crystal grains | Proportion of TbCu7 phase |
|---|---|---|---|---|---|---|
| $(Sm_{0.95}Y_{0.05})_{8.5}Fe_{79}N_{12.5}$ | 8.002 kGs | 12.154 kOe | 13.781 MGOe | 61 nm | 4.13 | 86 vol % |

Embodiment 2

A permanent magnetic material prepared by this embodiment has the following permanent magnet with the alloy composition of $(Sm_{0.8}Y_{0.2})_{8.5}Fe_{79}N_{12.5}$ (at %). The specific steps are as follows.

(1) A master alloy of the above alloy composition is prepared, wherein the elements Sm, Y, and Fe in the raw material are added in the form of pure metals; and then the following steps are executed to prepare a samarium-iron-nitrogen rare-earth permanent magnetic material.

(2) The prepared raw material is placed into a vacuum arc furnace to be melted uniformly. The power current is closed, and the alloy liquid is cooled to obtain a master alloy ingot. The prepared ingot is placed into high-vacuum single-roller rotating melt-spinning equipment, and is melted at a high temperature. Then, the melt is cast to a rotating roller for melt spinning, and is cooled at a cooling rate of $8*10^{5}$° C./s. The rapid cooling and melt spinning process is performed in a protective atmosphere; and the alloy liquid is sprayed onto the roller rotating at a speed of 30 m/s to obtain a melt-spun ribbon.

(3) The above melt-spun ribbon is crystallized, wherein the crystallizing temperature is 730° C., and the crystallizing time is 60 min.

(4) Water-cooling quenching is performed on the crystallized melt-spun ribbon in a flowing Ar gas atmosphere for 60 min; and the melt-spun ribbon is crushed into alloy powder having the average grain size of 85 μm by coarse crushing and grinding.

(5) The above crushed alloy powder is nitrided, wherein the nitriding temperature is 450° C., and the nitriding time is 20 h. After the nitriding process is completed, the yttrium-containing samarium-iron-nitrogen bonded magnetic powder is obtained.

Properties and other parameters of tested magnetic powder are as shown in Table 2.

TABLE 2

Magnetic properties and other parameters of yttrium-containing samarium-iron-nitrogen bonded permanent magnetic powder in Embodiment 2

| Nominal composition (at %) | $B_r$ | $H_{cj}$ | $(BH)_{max}$ | Average size of crystal phases | Deviation of crystal grains | Proportion of $TbCu_7$ phase |
|---|---|---|---|---|---|---|
| $(Sm_{0.8}Y_{0.2})_{8.5}Fe_{79}N_{12.5}$ | 8.442 kGs | 7.807 kOe | 10.414 MGOe | 72 nm | 3.86 | 87 vol % |

Embodiment 3

A permanent magnetic material prepared by this embodiment has the following permanent magnet with the alloy composition of $(Sm_{0.6}Y_{0.4})_{8.5}Fe_{79}N_{12.5}$ (at %). The specific steps are as follows.

(1) A master alloy of the above alloy composition is prepared, wherein the elements Sm, Y, and Fe in the raw material are added in the form of pure metals; and then the following steps are executed to prepare a samarium-iron-nitrogen rare-earth permanent magnetic material.

(2) The prepared raw material is placed into a vacuum arc furnace to be melted uniformly. The power current is closed, and the alloy liquid is cooled to obtain a master alloy ingot. The prepared ingot is placed into high-vacuum single-roller rotating melt-spinning equipment, and is melted at a high temperature. Then, the melt is cast to a rotating roller for melt spinning, and is cooled at a cooling rate of $4*10^{5}$° C./s. The rapid cooling and melt spinning process is performed in a protective atmosphere; and the alloy liquid is sprayed onto the roller rotating at a speed of 25 m/s to obtain a melt-spun ribbon.

(3) The above melt-spun ribbon is crystallized, wherein the crystallizing temperature is 680° C., and the crystallizing time is 60 min.

(4) Water-cooling quenching is performed on the crystallized melt-spun ribbon in a flowing Ar gas atmosphere for 60 min; and the melt-spun ribbon is crushed into alloy powder having the average grain size of 75 μm by coarse crushing and grinding.

(5) The above crushed alloy powder is nitrided, wherein the nitriding temperature is 450° C., and the nitriding time is 20 h. After the nitriding process is completed, the yttrium-containing samarium-iron-nitrogen bonded magnetic powder is obtained.

Properties and other parameters of tested magnetic powder are as shown in Table 3.

TABLE 3

Magnetic properties and other parameters of yttrium-containing samarium-iron-nitrogen bonded permanent magnetic powder in Embodiment 3

| Nominal composition (at %) | $B_r$ | $H_{cj}$ | $(BH)_{max}$ | Average size of crystal phases | Deviation of crystal grains | Proportion of $TbCu_7$ phase |
|---|---|---|---|---|---|---|
| $(Sm_{0.6}Y_{0.4})_{8.5}Fe_{79}N_{12.5}$ | 7.243 kGs | 7.936 kOe | 8.26 MGOe | 80 nm | 3.1 | 92 vol % |

Embodiments 4-6

The steps of each of these embodiments refer to those in Embodiment 1. Compositions and operating conditions of these embodiments are shown in Table 4 below, and test results of the magnetic properties of obtained products are shown in Table 5.

TABLE 4

Compositions and preparation conditions of permanent magnetic material in Embodiments 4-6

| | Nominal compositions (at %) | Rotating melt-spinning cooling rate (° C./s) | Rotating melt-spinning roller speed (m/s) | Crystallizing conditions (° C., min) | Quenching time (min) | Average grain size of alloy powder (nm) | Nitriding conditions (° C., h) |
|---|---|---|---|---|---|---|---|
| Embodiment 4 | $(Sm_{0.95}Y_{0.05})_{8.5}Fe_{79}N_{12.5}$ | $3*10^5$ | 20 | 770, 65 | 65 | 75 | 450, 24 |
| Embodiment 5 | $(Sm_{0.7}Y_{0.3})_{8.5}Fe_{79}N_{12.5}$ | $4*10^6$ | 40 | 730, 60 | 55 | 110 | 400, 20 |
| Embodiment 6 | $(Sm_{0.5}Y_{0.5})_{8.5}Fe_{79}N_{12.5}$ | $2*10^6$ | 35 | 700, 60 | 60 | 100 | 445, 18 |

TABLE 5

Magnetic properties of yttrium-containing samarium-iron-nitrogen bonded permanent magnetic materials in Embodiments 4-6

| | $B_r$ | $H_{cj}$ | $(BH)_{max}$ | Average size of crystal phases | Deviation of crystal grains | Proportion of $TbCu_7$ phase |
|---|---|---|---|---|---|---|
| Embodiment 4 | 5.61 KGs | 10.65 KOe | 6.453 MGOe | 79 nm | 4.99 | 83 vol % |
| Embodiment 5 | 6.54 KGs | 8.76 KOe | 8.21 MGOe | 61 nm | 2.56 | 90 vol % |
| Embodiment 6 | 7.149 KGs | 4.49 KOe | 5.499 MGOe | 70 nm | 2.12 | 100 vol % |

It can be seen from the above embodiments that the foregoing embodiments of the present disclosure realize the following technical effects. In the present disclosure, the rare-earth permanent magnetic material is prepared by regulating the ratio of the rare-earth element Y to the rare-earth element Sm; and disadvantages of higher coercivity and lower residual magnetism of the binary SmFeN material are overcome, so that the magnetic properties of the prepared magnetic powder can well meet a property requirement on a magnet in manufacturing of an electric motor, filling a gap in application of the properties of the magnet by the electric motor. The Y-added SmFe sample has an average grain size of 60-80 nm and the minimum standard deviation of 2.12. Compared with the standard deviation of the crystal grain size of the initial binary samarium-iron-nitrogen crystal phase that is 10.22, it is obvious that the sample has the more concentrated crystal grain size distribution and more uniform morphology distribution. The element Y has a stabilizing effect on the metastable phase $TbCu_7$-type SmFe. At a lower roller speed, the ratio of the $TbCu_7$ phase to the total phase increases and even a single phase is formed. Thus, the magnetic properties are significantly improved and the production cost is greatly reduced. However, when the content of Y is greater than 0.4, the magnetic properties are deteriorated as the coercivity is reduced too much, which is as shown in Embodiment 6.

Comparative Embodiment 1

It is the same as Embodiment 1, except the composition of $(Sm_{0.9}Y_{0.1})_{8.5}Fe_{79}N_{12.5}$.

Comparative Embodiment 2

It is the same as Embodiment 1, except the composition of $(Sm_{0.9}Y_{0.1})_{8.5}Fe_{78}Nb_1N_{12.5}$.

Comparative Embodiment 3

It is the same as Embodiment 1, except the composition of $(Sm_{0.9}Y_{0.1})_{8.5}Fe_{78}Co_1N_{12.5}$.

Comparative Embodiment 4

It is the same as Embodiment 1, except the composition of $(Sm_{0.8}Y_{0.2})_{8.5}Fe_{79}N_{12.5}$.

Comparative Embodiment 5

It is the same as Embodiment 1, except the rotating melt-spinning cooling rate of $10^{5\circ}$ C./s.

Comparative Embodiment 6

It is the same as Embodiment 1, except the rotating melt-spinning cooling rate of $2*10^{6\circ}$ C./s.

Comparative Embodiment 7

It is the same as Embodiment 1, except the rotating melt-spinning roller speed of 30 m/s.

Comparative Embodiment 8

It is the same as Embodiment 1, except the rotating melt-spinning roller speed of 38 m/s.

Comparative Embodiment 9

It is the same as Embodiment 1, except the crystallizing conditions including 775° C. and 65 min.

Comparative Embodiment 10

It is the same as Embodiment 1, except the crystallizing conditions including 650° C. and 70 min.

Comparative Embodiment 11

It is the same as Embodiment 1, except the average grain size of the alloy powder of 80 μm.

Comparative Embodiment 12

It is the same as Embodiment 1, except the average grain size of the alloy powder of 150 μm.

Comparative Embodiment 13

It is the same as Embodiment 1, except the nitriding conditions including 445° C. and 24 h.

Comparative Embodiment 14

It is the same as Embodiment 1, except the nitriding conditions including 400° C. and 20 h.

The magnetic properties of the permanent magnetic materials obtained in Comparative Embodiments 1-16 are shown in Table 6 below.

TABLE 6

Magnetic properties of yttrium-containing samarium-iron-nitrogen isotropic permanent magnetic materials in Comparative Embodiments 1-16

| | $B_r$ (kGs) | $H_{cj}$ (kOe) | $(BH)_{max}$ (MGOe) | Average size of crystal phases (nm) | Deviation of crystal grains | Proportion of $TbCu_7$ phase |
|---|---|---|---|---|---|---|
| Comparative Embodiment 1 | 7.996 | 11.666 | 11.281 | 60 | 4.02 | 85 vol % |
| Comparative Embodiment 2 | 7.853 | 11.703 | 11.355 | 55 | 3.85 | 89 vol % |
| Comparative Embodiment 3 | 8.002 | 11.534 | 11.785 | 58 | 3.98 | 87 vol % |
| Comparative Embodiment 4 | 8.125 | 9.752 | 10.563 | 70 | 3.57 | 87 vol % |
| Comparative Embodiment 5 | 7.985 | 10.535 | 9.324 | 62 | 4.12 | 80 vol % |
| Comparative Embodiment 6 | 8.025 | 11.854 | 12.075 | 55 | 3.98 | 88 vol % |
| Comparative Embodiment 7 | 7.345 | 10.324 | 10.254 | 75 | 4.85 | 78 vol % |
| Comparative Embodiment 8 | 8.078 | 12.035 | 12.785 | 54 | 3.95 | 90 vol % |
| Comparative Embodiment 9 | 7.854 | 10.754 | 10.361 | 70 | 4.85 | 72 vol % |
| Comparative Embodiment 10 | 7.329 | 8.872 | 8.250 | 60 | 4.74 | 71 vol % |
| Comparative Embodiment 11 | 8.057 | 12.145 | 12.784 | 60 | 4.01 | 75 vol % |
| Comparative Embodiment 12 | 7.413 | 9.524 | 7.324 | 62 | 4.12 | 74 vol % |
| Comparative Embodiment 13 | 7.984 | 11.512 | 11.012 | 60 | 3.99 | 74 vol % |
| Comparative Embodiment 14 | 5.342 | 7.245 | 6.741 | 60 | 4.00 | 70 vol % |

From the Comparative Embodiments in Table 6, it can be seen that the higher the Y content is, the more favorable it is to stabilize the $TbCu_7$-type phase structure and the more concentrated the crystal grain distribution is. When the content of Y is 0.1-0.2, generally speaking, in consideration of the coercivity and the magnetic energy product, the magnetic properties are the best. Afterwards, the properties gradually degrade along with the increase of the content of Y. When the content of Y is greater than 0.4, the deterioration of the magnetic properties is more serious. The compound addition of the elements Y and Nb/Co and the synergistic effect reduce the viscosity of the rare-earth permanent magnetic powder, and improve the wettability. Meanwhile, the $TbCu_7$ phase structure is stabilized, and crystal grains are refined. The higher the roller speed is, the larger the cooling rate is, and the more favorable it is to refine the crystal grains. In this way, a single $TbCu_7$ phase structure is generated, facilitating the improvement of the magnetic properties.

In summary, the present disclosure provides the yttrium-added rare-earth permanent magnetic material and the preparation method thereof. The chemical formula of the material expressed in atomic mass is $(Y_xRE_{1-x})_aFe_{100-a-b}M_bN_c$, wherein $0.05 \le x \le 0.4$, $7 \le a \le 13$, $0 \le b \le 3$, $5 \le c \le 20$, and the balance is Fe, namely, bal=100-a-b-c; RE represents the rare-earth element Sm, or the combination of the rare-earth element Sm and any one or more elements of Zr, Nd and Pr; M represents Co and/or Nb; and N represents nitrogen. In the preparation method, the rare-earth element Y is utilized to replace the element Sm of the samarium-iron-nitrogen material. By regulating the ratio of the element Sm to the element Y, the viscosity of the alloy liquid can be reduced, and the amorphous forming ability of the material is enhanced, so that the production cost is reduced. The average crystal grain size of the prepared magnetic powder is 20-100 nm, and the standard deviation is 2-5. The crystal grain size distribution is more concentrated with respect to the binary SmFe, so that the deterioration of the magnetic properties caused by non-uniform particle size distribution is effectively avoided, thereby facilitating the improvement of the magnetic properties. The magnetic properties of the SmFeN material are effectively regulated by regulating the doping amount of the element Y, so that disadvantages of higher coercivity and lower residual magnetism are overcome. Thus, the magnetic properties of the prepared magnetic powder can well meet a property requirement on a magnet in manufacturing of an electric motor, filling a gap in application of the properties of the magnet by the electric motor.

It should be understood that the foregoing specific implementations of the present disclosure are only configured to exemplarily illustrate or explain the principle of the present disclosure, and do not constitute limitations to the present disclosure. Thus, any modification, equivalent replacement, improvement, etc. made without departing from the spirit and scope of the present disclosure should be encompassed by the protection scope of the present disclosure. In addition, the appended claims of the present disclosure are intended to cover all changes and modifications that fall within the scope and boundary of the appended claims, or equivalent forms of such scope and boundary.

The foregoing description of the exemplary embodiments of the present disclosure has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An yttrium (Y)-added rare-earth permanent magnetic material, wherein a chemical formula of the material expressed in atomic percentage is $(Y_xRE_{1-x})_aFe_{bal}M_bN_c$;

where $0.05 \le x \le 0.4$, $7 \le a \le 13$, $0 \le b \le 3$, $5 \le c \le 20$, and the balance is Fe, namely bal=100-a-b-c;

RE represents a rare-earth element Sm, or a combination of the rare-earth element Sm and any one or more elements of Zr, Nd and Pr; M represents Co and/or Nb; and N represents nitrogen;

wherein the material contains a $TbCu_7$ phase, a $Th_2Zn_{17}$ phase, and an α-Fe phase as soft magnetic phase;

the content of the $ThCu_7$ phase in the material is more than 70 vol % of the total volume content of the three phases;

the content of the $Th_2Zn_{17}$ phase is 0-30 vol % of the total volume content of the three phases, excluding 0; and the content of the α-Fe phase as soft magnetic phase in the rare-earth permanent magnet material is less than 1 vol % of the total volume content of the three phases;

the proportion of the element Y entering the $TbCu_7$ phase and/or the $Th_2Zn_{17}$ phase is 100%;

the rare-earth permanent magnetic material is prepared by the following steps:

(1) smelting an alloy containing Sm, Y, and Fe as main compositions and added with element Co and/or Nb into an ingot;

(2) casting the ingot after being melted to a rotating roller to be subjected to rotating melt-spinning cooling to obtain a melt-spun ribbon; the casting is implemented through a vacuum single-roller rotating melt-spinning method; further, a speed of the rotating melt-spinning roller is 20-40 m/s; and further, a cooling rate of the rotating melt-spinning cooling is $1 \times 10^{5}$° C./s to $5 \times 10^{6}$° C./s;

(3) quenching the melt-spun ribbon obtained in step (2) after being crystallized, and pulverizing the quenched melt-spun ribbon into an alloy powder; the crystallizing in step (3) has a temperature of 650-800° C.; and (4) nitriding the alloy powder obtained in step (3) in a tabular furnace to obtain the yttrium-added rare-earth permanent magnetic material.

2. The yttrium-added rare-earth permanent magnetic material of claim 1, wherein the atomic percentage of the element Sm in RE is more than 95%.

3. The yttrium-added rare-earth permanent magnetic material of claim 1, wherein the rare-earth permanent magnetic material has an average thickness of 20-40 μm, and is composed of nanometer crystals with an average crystal grain size of 20-100 nm, and an amorphous material; and a standard deviation of crystal grain sizes is 2-5.

4. The yttrium-added rare-earth permanent magnetic material of claim 1, wherein the rare-earth permanent magnetic material has an average thickness of 20-40 μm, and is composed of nanometer crystals with an average crystal grain size of 20-100 nm, and an amorphous material; and a standard deviation of crystal grain sizes is 2-5.

5. The yttrium-added rare-earth permanent magnetic material of claim 1, wherein an XRD peak of the rare-earth permanent magnetic material is wholly shifted rightwards by 1%-5%.

6. The yttrium-added rare-earth permanent magnetic material of claim 1, wherein the rare-earth permanent magnetic material has an average thickness of 20-40 μm, and is composed of nanometer crystals with an average crystal grain size of 20-100 nm, and an amorphous material; and a standard deviation of crystal grain sizes is 2-5.

7. The yttrrum-added rare-earth permanent magnetic material of claim 1, wherein $0 \leq b \leq 1.5$.

8. A preparation method of the yttrium-added rare-earth permanent magnetic material of claim 1, the method comprising the following steps:

(1) smelting an alloy containing Sm, Y, and Fe as main compositions and added with element Co and/or Nb into an ingot; wherein the smelting is vacuum induction smelting;

(2) casting the ingot after being melted to a rotating roller to be subjected to rotating melt-spinning cooling to obtain a melt-spun ribbon; the casting is implemented through a vacuum single-roller rotating melt-spinning method; further, a speed of the rotating melt-spinning roller is 20-40 m/s; and further, a cooling rate of the rotating melt-spinning cooling is $1\times10^{5\circ}$ C./s to $5\times10^{6\circ}$ C./s;

(3) quenching the melt-spun ribbon obtained in step (2) after being crystallized, and pulverizing the quenched melt-spun ribbon into an alloy powder; the crystallizing in step (3) has a temperature of 650-800° C.; and (4) nitriding the alloy powder obtained in step (3) in a tabular furnace to obtain the yttrium-added rare-earth permanent magnetic material.

9. The method of claim 8, wherein a temperature of the melt in step (2) is 200-400° C. higher than a melting point of a raw material for preparing the melt-spun ribbon;

a heat preservation time of the melting is 60-180 s.

10. The method of claim 8, wherein the crystallizing in step (3) has a temperature of 650-800° C., and a time of 40-70 min;

the crystallizing is performed in a flowing Ar gas atmosphere;

the quenching is water-cooling quenching;

the quenching process is performed in the flowing Ar gas atmosphere;

a quenching time is 50-70 min; and an average grain size of the alloy powder is 70-110 μm.

* * * * *